US005328329A

United States Patent [19]

Monroe

[11] Patent Number: 5,328,329

[45] Date of Patent: Jul. 12, 1994

[54] FAN BLADE WIDTH EXTENDER

[75] Inventor: Robert C. Monroe, Houston, Tex.

[73] Assignee: Hudson Products Corporation, Houston, Tex.

[21] Appl. No.: 86,293

[22] Filed: Jul. 6, 1993

[51] Int. Cl.[5] ..... F04D 29/38

[52] U.S. Cl. ..... 416/62; 416/5

[58] Field of Search ..... 416/5, 62, 146 R, DIG. 5, 416/23; 415/119

[56] References Cited

U.S. PATENT DOCUMENTS

| | | | |
|---|---|---|---|
| 2,450,440 | 10/1948 | Mills | 416/223 R |
| 4,618,313 | 10/1986 | Mosiewicz | 416/62 |
| 4,840,540 | 6/1989 | Kallergis | 415/119 |
| 4,892,460 | 1/1990 | Volk | 416/62 |

FOREIGN PATENT DOCUMENTS

| | | | |
|---|---|---|---|
| 315483 | 7/1929 | United Kingdom | 416/23 |
| 496700 | 12/1938 | United Kingdom | 416/62 |
| 856668 | 12/1960 | United Kingdom | 416/62 |
| 2193618 | 2/1988 | United Kingdom | 416/62 |

*Primary Examiner*—Edward K. Look
*Assistant Examiner*—James A. Larson
*Attorney, Agent, or Firm*—Robert J. Edwards; Michael L. Hoelter

[57] ABSTRACT

A width extender is used to modify existing fan blades in order to enable them to rotate at slower speed thereby reducing the noise associated with them while at the same time maintaining a proper work efficiency. The width extender is fixably connected along the trailing edge of an existing fan blade by adhesive bonding, riveting, welding, or otherwise. Width extender can be made of an extruded plastic material, preferably nylon, or it can be constructed of the same material as the fan blade itself. Ideally, the width extender would increase the width of the fan blade by 20% to 25%. Additionally, this width extender would have a uniform length so as to uniformly increase the entire width of the fan blade.

8 Claims, 1 Drawing Sheet

FAN BLADE WIDTH EXTENDER

FIELD OF THE INVENTION

The present invention relates in general to fan blades and in particular to a new and useful width extender for a fan blade for reducing noise.

BACKGROUND OF THE INVENTION

Due to environmental and noise considerations, there has been an increased effort in those industries which utilize fans to reduce the amount of noise produced by the fans.

One effort aimed at reducing fan noise is to operate the axial flow fans at lower tip speeds thereby reducing noise output which improves the surrounding environment. One problem encountered, however, is that decreasing the tip speed of the fan also decreases the ability of the fan to perform work. By decreasing the tip speed of the fan, work is decreased by the square of the revolutions per minute (RPM). A fan that can produce a total pressure of 1" at a tip speed of 12,000 feet per minute (FPM) can only produce 0.25" total pressure at a tip speed of 6,000 FPM.

Presently, there is no known fan that reduces noise without significantly decreasing the ability to perform work.

It is an object of the present invention to provide a fan blade that reduces noise.

It is another object of the present invention to provide a fan blade that produces greater capability for performing more work at slower tip speeds.

It is another object of the present invention to provide a width extender for a fan blade which is adaptable to the trailing edge of a fan blade.

These and other objects and advantages of the present invention will become obvious upon further investigation.

SUMMARY OF THE INVENTION

The present invention provides for a width extender for a fan blade which reduces fan noise while producing more pressure capability thus allowing the fan blade to perform more work at slower tip speeds. The work that a fan blade can do is directly related to its width and by rotational speed squared.

The present invention is a width extender which is fixably connected to the trailing edge of an existing fan blade. According to the present invention, the width extender can comprise an extruded plastic such as nylon or it can be made of the same material as the fan blade. The width extender can be fixably connected to the fan blade by adhesive bonding, riveting or welding to the fan blade.

DESCRIPTION OF THE PREFERRED EMBODIMENTS

Figure 1:
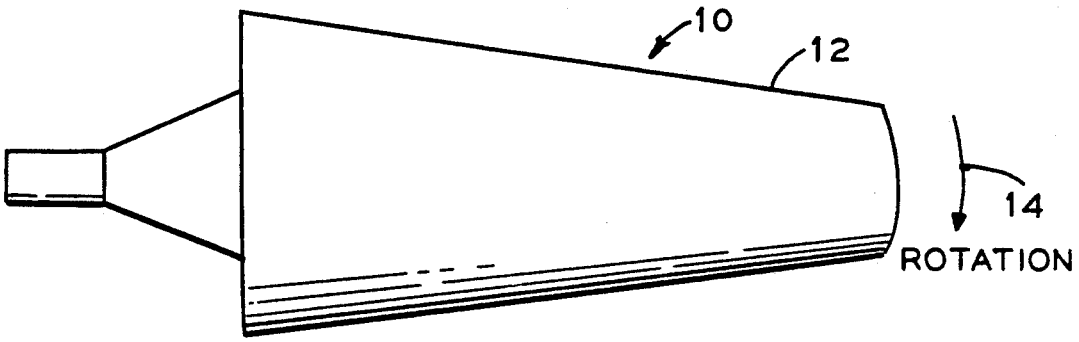
FIG. 1 (PRIOR ART)
FIG. 1 is a top view of a known fan blade.

FIG. 1 illustrates a known fan blade, generally designated 10, having a trailing edge 12 when rotated in rotation direction 14. Fan blade 10 can be of molded or extruded construction if so desired.

Figure 2:
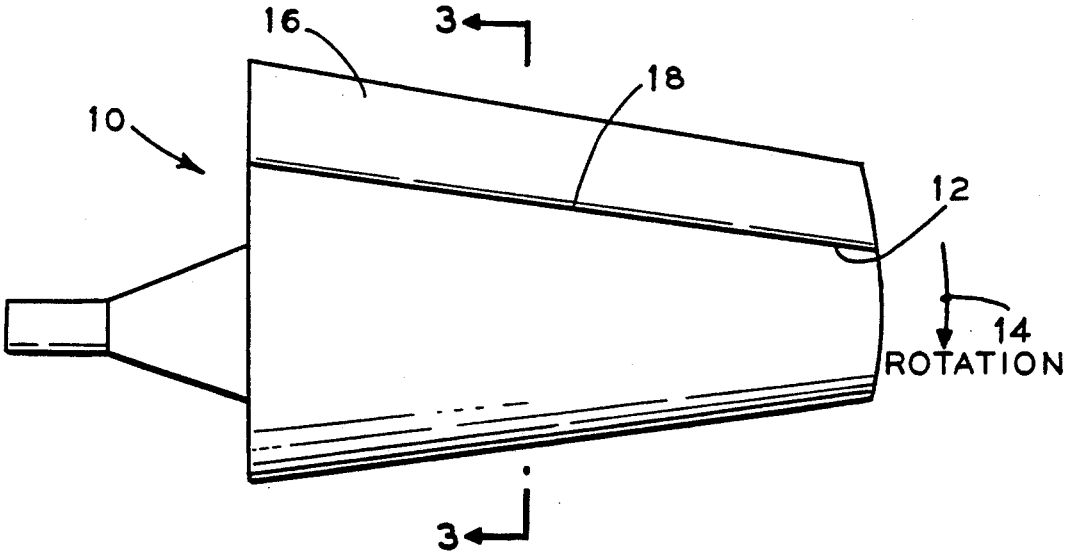
FIG. 2 is a top view of a fan blade according to the present invention.
Figure 3:
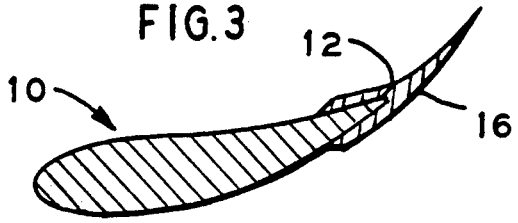
FIG. 3 is a sectional view taken along lines 3—3 of FIG. 2.

According to the present invention, as illustrated in FIGS. 2 and 3, fan noise is reduced by providing an extender or extension 16 at trailing edge 12 of fan blade 10 thereby enabling fan blade 10 to rotate at a slower speed. Extension 16 provides for a reduction in noise generated by fan blade 10 while at the same time increasing the performance of work through greater pressure capability of fan blade 10, even though fan blade 10 is operating at a lower tip speed.

Extension 16 extends along trailing edge 12 of fan blade 10 and it is preferable for extension 16 to extend along the entire length of trailing edge 12. It is also preferable for extension 16 to have a constant or uniform width in order to provide a uniform increase in the width of fan blade 10.

Extension 16 can be made of a rugged material such as an extruded plastic, preferably nylon. Extension 16 can also be made of the same material as fan blade 10 itself if so desired. Extension 16 generally is fixably connected to existing fan blade 10 at trailing edge 12 at connection 18 through adhesive bonding, riveting, welding or any other suitable fixing method for securing extension 16 to fan blade 10.

A practical addition of width would add about 4 to 5 inches, more or less, to the width of fan blade 10, with the bond width being about 2 to 3 inches, more or less. Ideally, by connecting extension 16 to trailing edge 12 of fan blade 10, the width of fan blade 10 is increased 10% to 35% of the original width of fan blade 10. It is preferable, however, to have extension 16 increase the width of fan blade 10 by at least 20% to 25%.

As shown, the present invention allows for the modification of existing fan blades 10 without having to replace them. It enables the curvature of trailing edge 12 to be enhanced or exaggerated (see FIG. 3) thereby permitting blade 10 to perform more work by moving more air. Moreover, the present invention provides for an inexpensive and simple method of reducing the noise associated with existing fan blades 10. Additionally, the present invention enables the user to achieve a reduction in noise by reducing the fan speed while at the same time maintaining fan work efficiency.

While a specific embodiment of the invention has been shown and described in detail to illustrate the application of the principles of the invention, it will be understood that the invention may be embodied otherwise without departing from such principles.

What is claimed is:

1. A fan blade width extender comprising:

(a) an elongated fan blade having a tip, a tapering or constantly narrowing cross-section along its length toward said tip, and a trailing edge, said narrowing cross-section having a curved or non-linear central axis;

(b) elongated extension means for extending the width of the fan blade, said extension means having a constant or non-tapering cross-section and being secured along said trailing edge of the fan blade and being constructed of an extruded plastic material; and (c) connecting means for rigidly and fixedly securing said elongated extension means along said trailing edge of the fan blade.

2. The width extender as set forth in claim 1 wherein said elongated extension means extend along the entire length of said trailing edge of said fan blade.

3. The width extender as set forth in claim 2 wherein said elongated extension means increases the width of said fan blade in a range of from 10% to 35%.

4. The width extender as set forth in claim 2 wherein said elongated extension means increases the width of said fan blade in a range of from 20% to 25%.

5. A method of increasing static pressure capability of an elongated fan blade having a trailing edge and a tip comprising the step of fixedly connecting elongated extension means along the trailing edge of the fan blade for extending the width of the fan blade thereby permitting the fan blade to operate at lower speeds so as to reduce noise while maintaining operating performance, said elongated extension means having a constant or non-tapering cross-section while the fan blade itself has a tapering or constantly narrowing cross-section along its length toward the tip with said constantly narrowing cross-section of the fan blade having a curved or non-linear central axis.

6. The method as set forth in claim 5 further comprising the step of extending said elongated extension means along the entire length of the trailing edge of the blade.

7. The method as set forth in claim 5 further comprising the step of increasing the width of the fan blade by 10% to 35%.

8. The method as set forth in claim 5 further comprising the step of increasing the width of the fan blade by 20% to 25%.

* * * * *